United States Patent [19]

McCord et al.

[11] Patent Number: 4,967,720

[45] Date of Patent: Nov. 6, 1990

[54] TRAP SHOOTING MACHINE

[75] Inventors: Patrick J. McCord, Charlotte, N.C.; Lloyd G. Moore, Lancaster, S.C.

[73] Assignee: Yale Security Inc., Monroe, N.C.

[21] Appl. No.: 435,731

[22] Filed: Nov. 13, 1989

[51] Int. Cl.[5] ..... F41B 3/04

[52] U.S. Cl. ..... 124/8; 124/47

[58] Field of Search ..... 124/8, 6, 47, 46, 43, 124/42, 9

[56] References Cited

U.S. PATENT DOCUMENTS

| | | | |
|---|---|---|---|
| 1,280,089 | 9/1918 | Schmidt | 124/8 |
| 2,934,056 | 4/1960 | Lauterbach | 124/46 X |
| 3,070,082 | 12/1962 | Foster | 124/8 |
| 3,093,127 | 6/1963 | Starr | 124/8 |
| 3,108,582 | 10/1963 | Darrell | 124/6 |
| 3,677,257 | 7/1972 | Segerkvist | 124/8 |
| 3,841,293 | 10/1974 | Laporte et al. | 124/8 |
| 4,706,641 | 11/1987 | Cote et al. | 124/8 |
| 4,747,390 | 5/1988 | Storm | 124/6 |

*Primary Examiner*—Peter M. Cuomo

*Attorney, Agent, or Firm*—Dallett Hoopes

[57] ABSTRACT

This trap shooting machine dispenses clay pigeons onto its flinger arm at random locations so that when the flinger arm is activated, the pigeons are projected successively in random directions to be more challenging to the marksman. This is accomplished by a carriage which moves back and forth over the flinger arm, the carriage supporting a supply of pigeons and dispensing them onto the flinger arm at random spots, one for each "pull".

6 Claims, 3 Drawing Sheets

TRAP SHOOTING MACHINE

BACKGROUND OF THE INVENTION

1. Field of the Invention

This invention relates to a trap shooting machine. More specifically, this invention relates to such a machine adapted to load itself and hurl clay pigeons successively in random directions.

2. Description of Related Art including Information Disclosed under §§1.97 to 1.99

In trap shooting, at one time the targets were thrown out by a spring-loaded machine tended to by a boy located in a protected pit in front of the marksman. The boy would load and cock the machine and trigger it on call. Such help is no longer readily available. It has become usual, therefore, for targets to be launched by an electrically operated clay pigeon flinger. Such a flinger may be loaded with the clay pigeon by the marksman who, when he is ready, closes a switch to initiate the cycle of the automatic flinger. Such flingers are commercially available on the market, one under the trademark "QUIKFIRE".

It has been common in skeet shooting to have two such machines aimed in different directions so that they can be fired off simultaneously and an agile and quick marksman can pick off the clay pigeons successively, one high on the right and one low on the left, for instance. However, even this routine becomes somewhat old in that the patterns of projectiles from a given machine are more or less uniform with the same settings and after a while the projectiles hurled in such an arrangement offer no surprises.

As a further development, one U.S. patent discloses a thrower adapted to launch two clay pigeons on the same fling, one further advanced on the flinger plate than the other so that the two pigeons are projected off at different angles. This is disclosed in U.S. Pat. No. 4,706,641 to Cote. Here again, the pigeons are thrown in the predictable directions so that the marksman again eventually has no surprises.

There has been a need for an automatic trap shooting machine which will throw successive targets in random directions. The demand for such an arrangement is primarily from the more expert marksman seeking further challenge.

SUMMARY OF THE INVENTION

Under the present invention there is provided what may be viewed as an adjunct or attachment to a standard electrically driven trap shooting machine.

The attachment includes a clay pigeon supporting and dispensing device mounted above the flinger arm of the standard trap shooting machine. It also includes means for moving at least the lower portion of the supporting and dispensing device back and forth over the flinger arm to a random location, and electric activating means for dispensing a clay pigeon from the lower portion onto the flinger arm at the random location and for causing the flinger arm to hurl its pigeon. By this means successive clay pigeons landing on the flinger arm in the random locations will be flung in random directions respectively when the flinger arm swings.

Clearly the invention may also be expressed as a new type of trap-shooting machine rather than as an attachment for a standard machine.

BRIEF DESCRIPTION OF THE DRAWINGS

Other features and objects of the invention will be clear from a study of the following specification and reference to the drawings, all of which disclose a non-limiting embodiment of the invention. In the drawings.

DESCRIPTION OF THE PREFERRED EMBODIMENT

A commercially available trap shooting machine (FIG. 1) comprises a housing H which is generally rectangular and a flinger arm FA which is a flat plate. To the rear edge of the plate is secured an upward flange U against which the clay pigeons C rest at the beginning of the swing. The arm pivots about shaft P, and the housing may be mounted on an adjustable stand (not shown).

Figure 1:
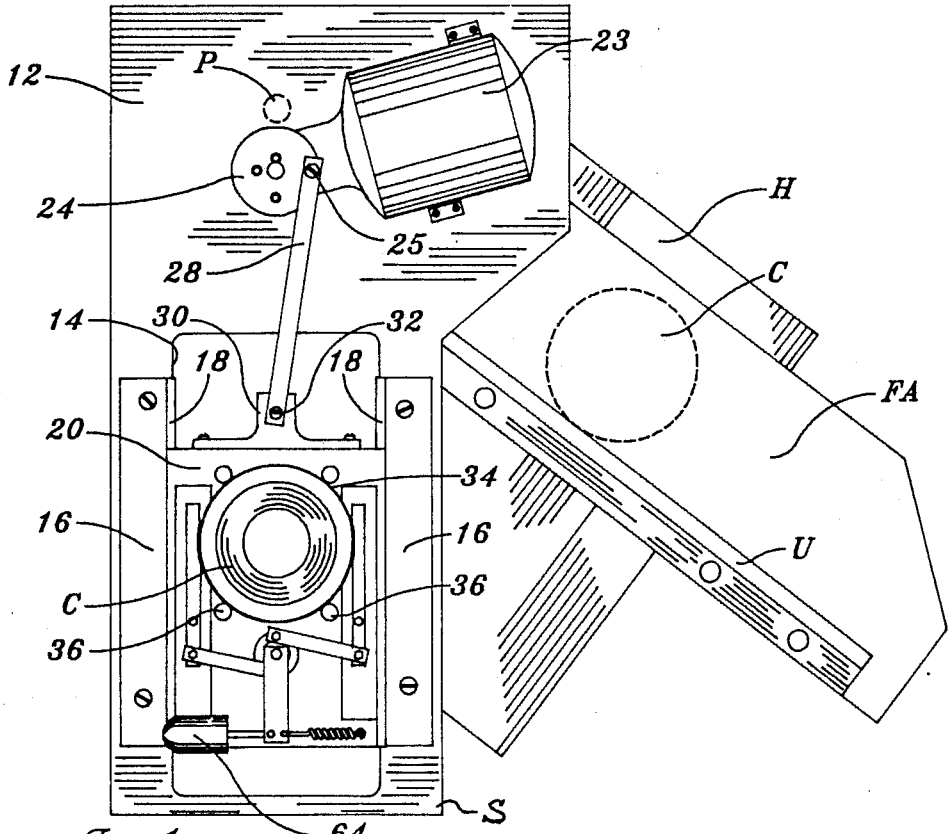
FIG. 1 is a top plan view of an attachment embodying the invention showing the flinger arm commencing to swing.
Figure 3:
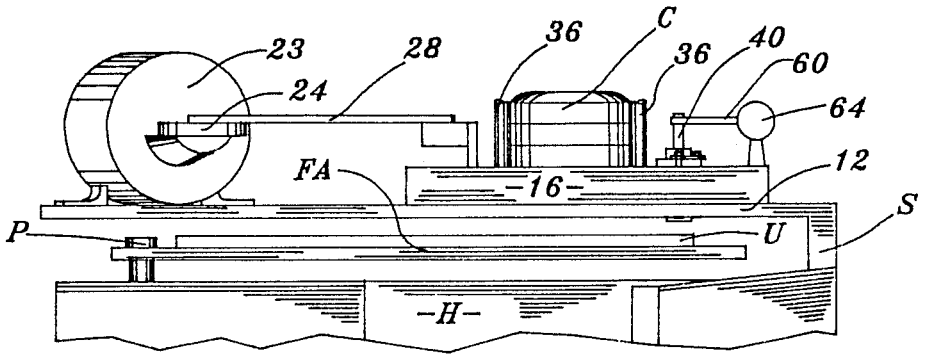
FIG. 3 is a side elevational view, partly compacted and taken from the left hand side of the FIG. 1 view and showing the clay pigeon supporting and dispensing means above the flinger arm.

Mounted above the flinger arm and parallel thereto is the automatic loading attachment generally designated 10. It comprises a stationary platform 12 having a large opening 14 (FIG. 1). The platform 12 is supported cantilever fashion on a vertical standard S rigidly secured to the housing H.

Figure 6:
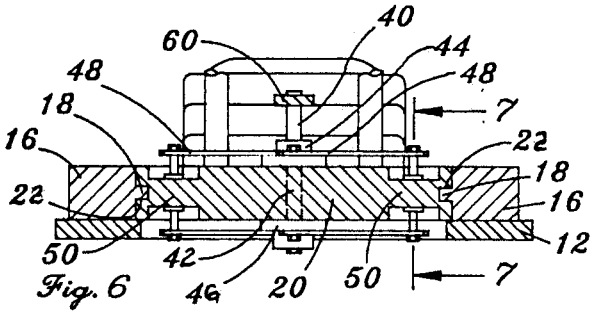
FIG. 6 is a sectional view taken on the line 6—6 of FIG. 4.
Figure 7:
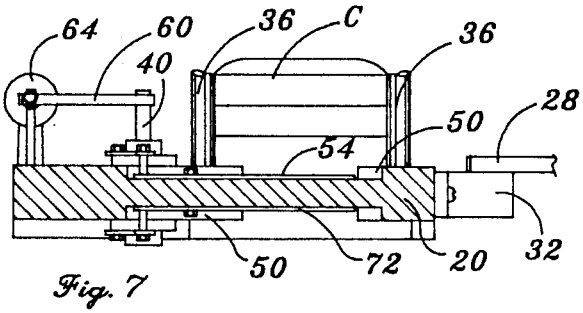
FIG. 7 is a sectional view taken on the line 7—7 of FIG. 6.

On either side of the opening are secured parallel tracks 16 which have inward rails 18 (FIG. 6). A rectangular carriage 20 is provided and is formed with outwardly facing parallel grooves 22 which receive the rails 18 in sliding relation. The carriage 20 is thereby adapted to travel back and forth along the tracks 16.

Motor 23 having a built-in speed reducer is mounted adjacent one end of the platform 12. The motor drives a disk 24 disposed parallel to the platform 12 and the disk eccentrically mounts a bearing 26 to which is connected one end of a drive link 28. A pad 30 is mounted at the adjacent end of the carriage 20 and is pivotally attached by a bearing pin 32 to the other end of the link 28. Thus, when the motor 22 is energized and disk 24 rotates, the carriage 20 moves back and forth over the opening 14 on the rails 18 of the tracks 16.

The carriage 20 is formed with an opening 34 adapted to pass the clay pigeons C one by one. The opening is surrounded by the vertical guide pins 36 which serve to center a stack of pigeons C.

A shaft 40 is journaled in an appropriate opening 42 in the carriage 20 and has fixedly mounted thereon the upper drive plate 44 and lower drive plate 46. Diametrically opposed points on the upper drive plate 44 are pivotally attached to shutter drive links 48 respectively. The carriage is reduced in thickness as at 50 on its opposite sides and in this area is pivotally secured as at 52 a pair of upper shutters 54.

Adjacent their ends proximate the pigeons C the shutters may be thinned as at 56 for reasons which will appear. At the ends opposite the thinned areas, bolts 58 attach the shutters respectively to the shutter drive links 48. The upper end of the shaft 40 (FIG. 6) has mounted thereon a fixed arm 60, the distal end of which is attached to the armature 62 of a solenoid 64. A spring 66 at one end is attached to the arm 60. At the other end the spring 66 is attached to the carriage 20.

Figure 4:
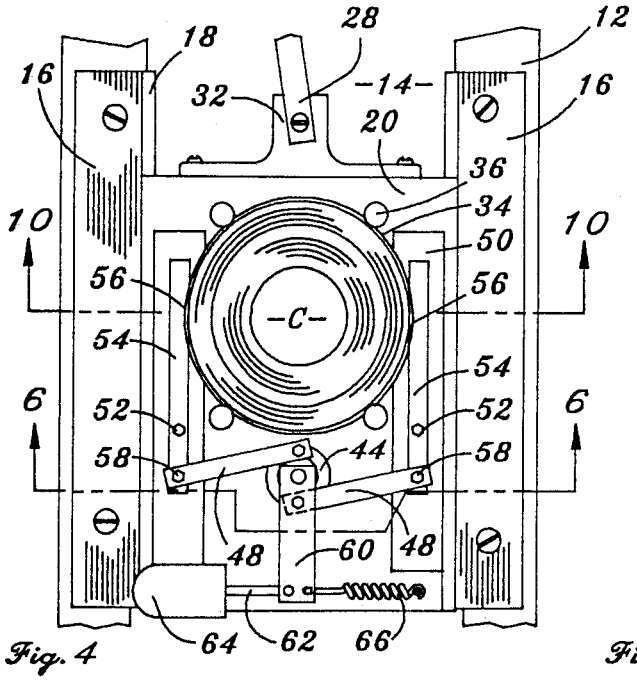
FIG. 4 is an enlarged fragmentary plan view showing the clay pigeon dispenser with its upper shutters closed.
Figure 5:
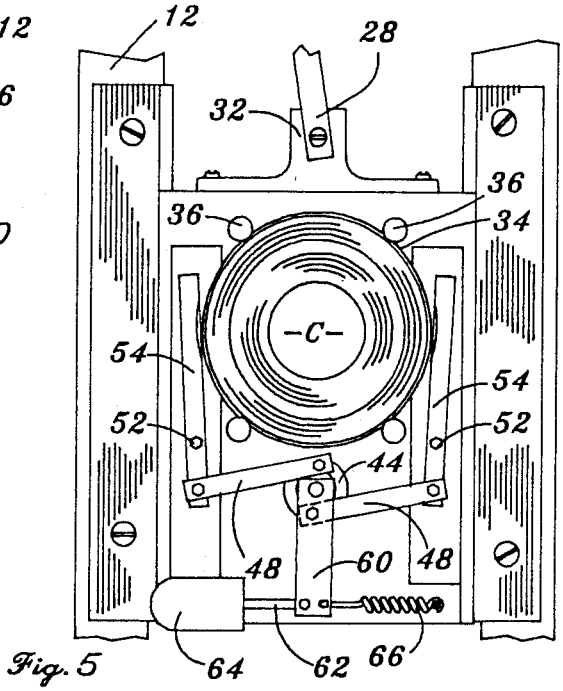
FIG. 5 is similar to FIG. 4 but showing the dispenser with the upper shuters open.

By virtue of this arrangement when the solenoid 66 is activated (FIG. 4) the armature 62 pulls the arm 60 toward the solenoid cylinder 64 against the bias of spring 66. This causes the links 48 to push the adjacent arms of the shutters 54 outward causing the thinned ends 56 to move inward closing against the lower edge of the adjacent clay pigeon Cl (FIG. 10).

Figure 8:
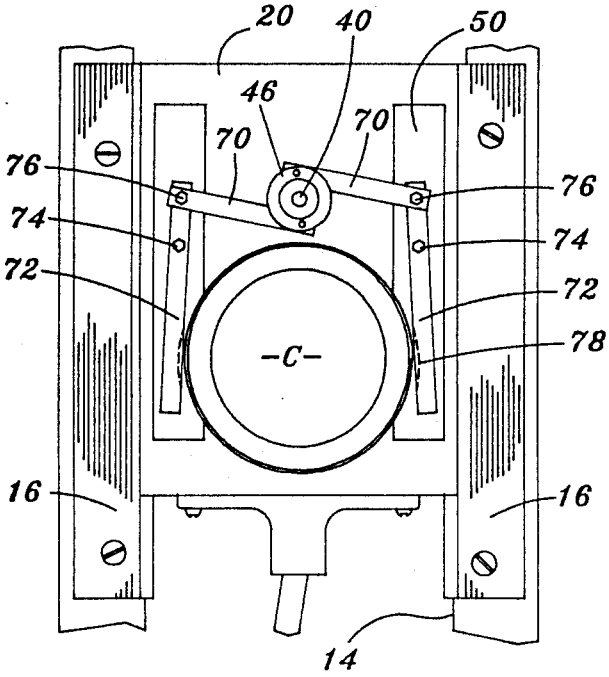
FIG. 8 is a bottom plan view of the clay pigeon supporting and dispensing means with the lower shutters open.
Figure 9:
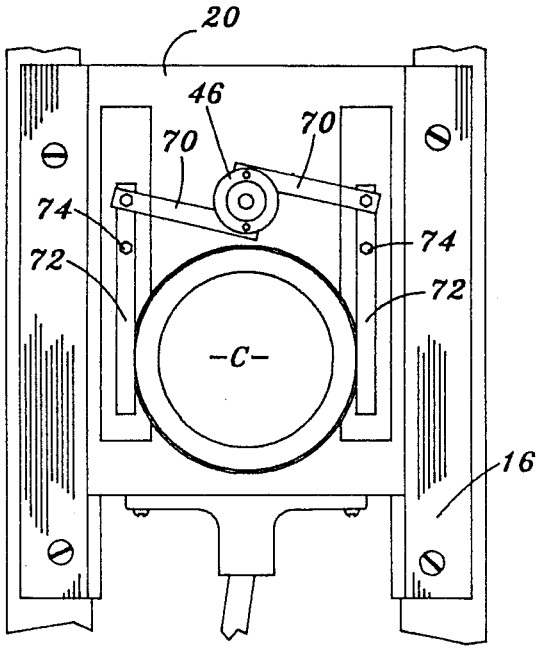
FIG. 9 is similar to FIG. 8 but shows the lower shutters closed.

The lower drive plate 46 has connected to it at diametrically opposed positions (FIG. 8) the lower shutter drive links 70. Lower shutters 72 are pivoted as at 74 in the reduced areas 50 on either side of the bottom of the carriage 20. The drive links 70 have their outer ends pivoted to bolts 76 which are mounted on ends of the shutters 72 respectively. Adjacent their opposite ends the lower shutters are thinned as at 78.

Thus, as the shaft 40 is rotated as the arm 60 is moved by the solenoid/spring arrangement 64, 66, not only upper shutters 54 change positions but also by a similar arrangement the lower shutters 72 change positions oppositely: that is, when the upper shutters are moved to the closed position to engage the underside of the next above clay pigeon, the lower shutters open, and vice-versa.

Figure 10:
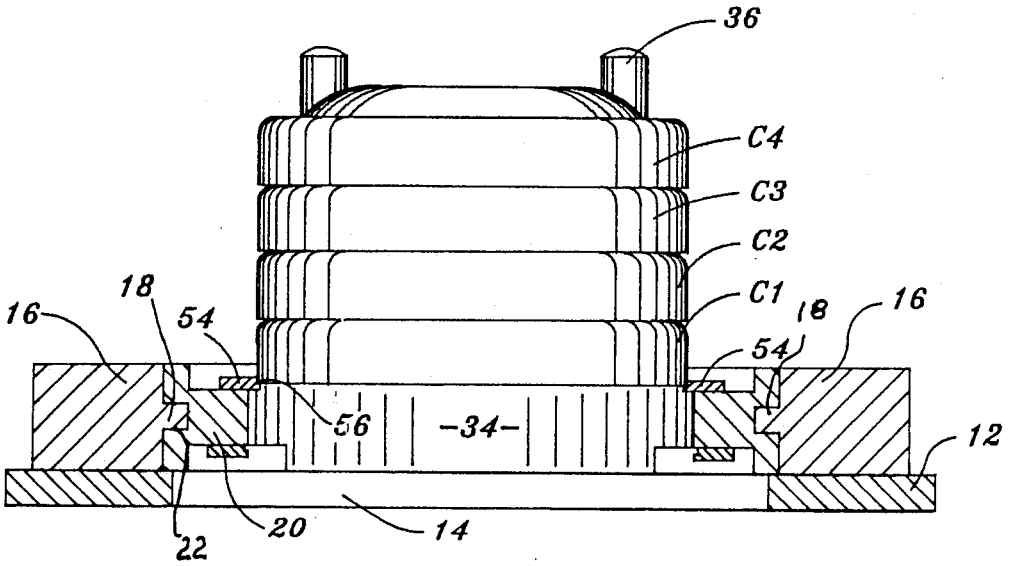
FIGS. 10, 11 and 12 are enlarged fragmentary views of the clay pigeon supporting and dispensing means and showing the shutters working alternately to dispense a single clay pigeon onto the flinger arm therebelow (not shown).
Figure 11:
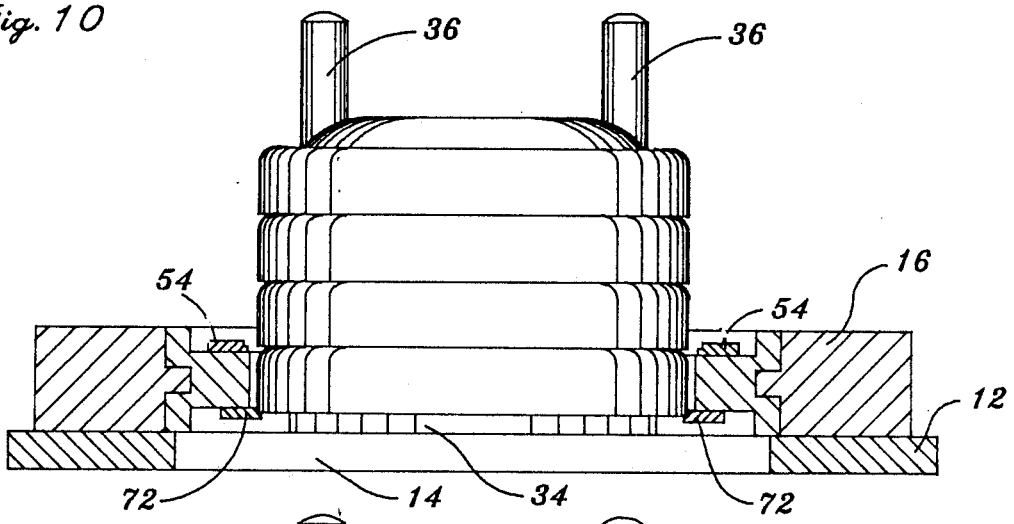
Figure 12:
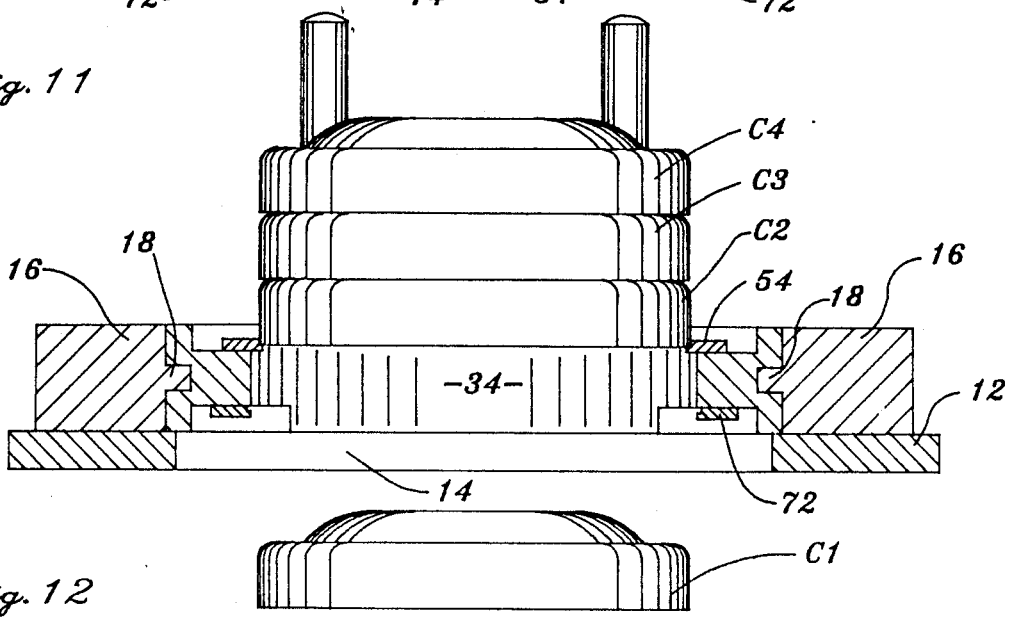

The sequence of operations by which a single clay pigeon Cl is dispensed is shown in FIGS. 10 through 12. Essentially, the closed upper shutters 54 (FIG. 10) support the entire stack Cl through C4 of pigeons. With the deactivating of the solenoid 64 (FIG. 4) the arm 60, biased by spring 66, moves to the left causing the links 48 to open the shutters 54. Simultaneously (FIG. 11) the lower shutters 72 are closed as the drive plate 46 (FIG. 8) rotates clockwise.

Subsequently, upon actuation of the solenoid 64 the arm 60 will move to the right causing the upper shutters 54 to close and the lower shutters 72 to open (FIG. 12). This permits the clay pigeon Cl to drop, separating from the rest of the stack. Upon each separate relocation and actuation of the solenoid 64 the lowermost clay pigeon will be separated and dropped as shown in the sequence FIGS. 10 through 12.

A brush (not shown) may be mounted bristles-down stationarily on the underside of the platform adjacent the opening 14 to sweep the clay pigeon on the arm FA gently against the flange U as the arm passes below.

In the drawings the electric leads used are not shown to avoid cluttering up the figures. It will be clear to those skilled in the art that the solenoid 64 should be operated only when the flinger arm FA is directly underneath the stack of clay pigeons C as the arm is rotated to the launch position. This can be arranged by having a limit switch contact the flinger arm FA when that arm is in the proper position, or a switch operated by a cam on the shaft P of the flinger arm can be employed.

The operation of the shutters 54, 72 in no way depends upon the position of the carriage 20 along the track 16. Thus whether the carriage is at its closest point to the disk 24 or at its farthest point from the disk 24 or somewhere inbetween, has no bearing on the random point at which the shutters 54, 72 are operated to dispense a clay pigeon C1 onto the flinger arm FA. Electric circuitry need only ensure that the shutters do not operate except when the flinger arm FA is directly under the opening 34.

Figure 2:
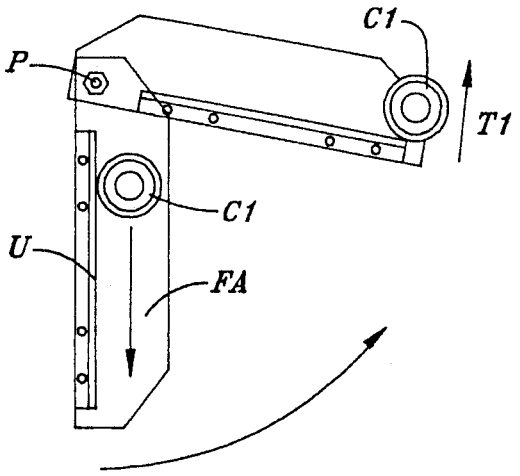
FIG. 2 and 2*a* are reduced schematic views of the flinger arm only and demonstrating how the position on which the pigeon is loaded onto the flinger arm affects the direction in which it is hurled.

The dispensing position of the clay pigeon C1 on the flinger arm governs the point at which it leaves the end of the arm (FIG. 2). Thus, during the commencement of the swing of the flinger arm A the pigeon C1 will roll outwardly under centrifugal force along the flange U and will reach the end of the flange as the arm FA approaches its maximum speed. This will cause the pigeon C1 to leave the arm on a tangent line T1 of the end of the flinger arm at that time.

Figure 2A:
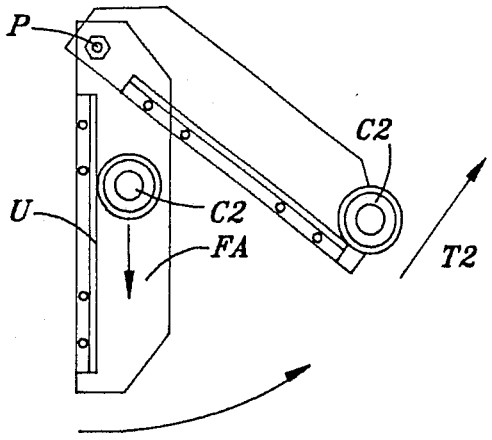

If the next clay pigeon C2 (FIG. 2*a*) is dropped by the dispenser at a point on the flinger arm farther from the pivot P,—farther out from than where the first pigeon C1 was dropped (shown in exaggerated outward position in FIG. 2*a*)—the pigeon C2 has less far to roll along the flange U to reach the end thereof. This will mean that the pigeon C2 will leave the arm FA at an earlier point in the swing so that it travels on a different tangent T2 and therefore a different direction from the tangent T1 of the pigeon C1.

While it is intended that the carriage 20 continuously reciprocate back and forth on the tracks 16 during the trap shooting session, it can be seen that it is not necessary that the reciprocation be continuous. After each shot the motor 23 may be activated for a brief period until it arrives at another random spot over the flinger arm FA. The motor can then be stopped. The pigeon dispensed at this spot will then be projected in a different direction from the last projection. The marksman will have no idea just where the next pigeon will be thrown, provided there has been some travel of the carriage 20 since the last projection.

Thus, we have developed a trap shooting machine which projects target pigeons in random successive directions to challenge even the more expert marksman. In the form disclosed, the result has been achieved by a simple attachment to a commercially available shooting unit. However, the invention may take the form of an entirely new machine "from the ground up".

It will, therefore, be apparent to those skilled in the art that while a single embodiment of the invention has been disclosed, the invention is not so limited but may be defined in accordance with the following claim language or reasonable equivalents thereof.

What is claimed is:

1. A trap-shooting machine comprising:

(a) a motor-containing base, (b) a flinger arm for clay pigeons having an upward flange along the trailing side thereof and operatively connected to the motor-containing base, (c) clay-pigeon-supporting and dispensing means above the flinger arm to drop the pigeons one-by-one onto the flinger arm, (d) means for moving the supporting and dispensing means back and forth over the flinger arm so that each pigeon drops onto the flinger are in a random location, (e) electric activating means for dispensing one clay pigeon from the supporting and dispensing means onto the flinger arm at the random location and for causing the flinger arm to swing, whereby the successive clay pigeons landing on the flinger arm in the random locations will be flung in random directions respectively when the flinger arm swings.

2. A trap-shooting machine comprising:

(a) a motor-containing base, (b) a flinger arm for clay pigeons having an upward flange along the trailing side thereof and operatively connected to the motor-containing base on an axis of rotation, (c) track means supported above the flinger arm and generally radial with respect to the axis, (d) a carriage on the track means, (e) means for continuously reciprocating the carriage on the track means, (f) supporting and dispensing means on the carriage for supporting a vertical stack of clay pigeons, and for dispensing the pigeons from the stack onto the flinger arm one-by-one, (g) electric means for activating the supporting and dispensing means and the motor on the motor-containing base to dispense a pigeon onto the flinger arm at a random location, depending on the position of the carriage on the track means, and for activating the motor-containing base to swing the flinger arm, whereby the pigeon, landing on the flinger arm at the random location will be flung in a random trajectory.

3. A trap-shooting machine as claimed in claim 2 wherein the carriage is a plate adapted to ride on the track means and the plate is formed with an opening therein large enough to pass a clay pigeon and the supporting and dispensing means includes on the opposite faces of the plate alternately working upper and lower shutter means, the upper shutter means when closed supporting the stack of pigeons, the lower shutter means when open permitting the lowest clay pigeon only to drop onto the flinger arm.

4. A trap-shooting machine as claimed in claim 2 wherein the electric means includes solenoid means for operating the shutters alternately.

5. A trap-shooting machine as claimed in claim 4 wherein the upper and lower shutter means are each a pair of pivoted levers on opposite sides of the opening respectively and are connected by links to opposite eccentric points on a drive plate driven in a rotary direction by the solenoid.

6. A trap-shooting machine as claimed in claim 2 wherein the means for continuously reciprocating the carriage comprises a separate motor having a rotary plate with a connecting link connecting the carriage to an eccentric location on the plate.

* * * * *